US010755682B2

(12) United States Patent
Kante et al.

(10) Patent No.: US 10,755,682 B2
(45) Date of Patent: Aug. 25, 2020

(54) APPARATUS FOR SOUND MODULATION

(71) Applicant: ElectroSpit LLC, Oakland, CA (US)

(72) Inventors: Bosco Kante, Oakland, CA (US); Maya Kante, Oakland, CA (US)

(73) Assignee: ElectroSpit CA (US)

( * ) Notice: Subject to any disclaimer, the term of this patent is extended or adjusted under 35 U.S.C. 154(b) by 0 days.

(21) Appl. No.: 16/185,004

(22) Filed: Nov. 8, 2018

(65) Prior Publication Data

US 2019/0318713 A1 Oct. 17, 2019

Related U.S. Application Data

(60) Provisional application No. 62/583,083, filed on Nov. 8, 2017.

(51) Int. Cl.

| | |
|---|---|
| ***G10H 1/053*** | (2006.01) |
| ***G10H 1/00*** | (2006.01) |
| ***G10H 1/32*** | (2006.01) |

(52) U.S. Cl.

CPC ..... *G10H 1/053* (2013.01); *G10H 1/0008* (2013.01); *G10H 1/32* (2013.01); *G10H 2210/195* (2013.01); *G10H 2220/361* (2013.01)

(58) Field of Classification Search

CPC ..... G10H 1/053; G10H 1/32; G10H 1/0008; G10H 2210/195; G10H 2220/361

USPC ..... 84/737

See application file for complete search history.

(56) References Cited

U.S. PATENT DOCUMENTS

| | | | | |
|---|---|---|---|---|
| 5,171,930 | A * | 12/1992 | Teaney | A61B 5/04886 381/118 |
| 5,794,203 | A * | 8/1998 | Kehoe | A61F 5/58 704/271 |
| 6,270,466 | B1 * | 8/2001 | Weinstein | A61B 5/0488 600/590 |
| 2014/0342324 | A1 * | 11/2014 | Ghovanloo | G09B 5/06 434/185 |
| 2017/0042479 | A1 * | 2/2017 | Shimuta | A61B 5/0245 |
| 2018/0068103 | A1 * | 3/2018 | Pitkanen | H04L 63/0861 |

* cited by examiner

*Primary Examiner* — Jeffrey Donels

(74) *Attorney, Agent, or Firm* — The Law Office of Herbert T. Patty

(57) ABSTRACT

The present disclosure is hands-free sound modulation apparatus. The hands-free sound modulation apparatus includes one more monophonic and polyphonic sound modulation assemblies for music creation, gaming, medical rehabilitation, language training, and speech enhancement. The hands-free sound modulation apparatus can be paired with a smartphone device, musical instrument, and a network of hands-free sound modulation apparatuses.

19 Claims, 6 Drawing Sheets

126

APPARATUS FOR SOUND MODULATION

PRIORITY

This application is claims priority under 35 U.S.C. § 119(e), of U.S. Provisional Patent Application No. 62/583,083, filed on Nov. 8, 2017, the content of which is incorporated herein by reference in its entirety.

BACKGROUND

A talk box is a device used by musicians to modify the sound from a musical instrument such as a keyboard. Traditional talk box devices direct sound from the musical instrument into a musician's mouth by means of a plastic tube adjacent to their vocal microphone. The talk box device allows the musician to control the modification of the instrument's sound by changing the shape of the musician's mouth.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Illustrative examples of the subject matter claimed below will now be disclosed. In the interest of clarity, not all features of an actual implementation are described in this specification. It will be appreciated that in the development of any such actual implementation, numerous implementation-specific decisions may be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Further, as used herein, the article "a" is intended to have its ordinary meaning in the patent arts, namely "one or more." Herein, the term "about" when applied to a value generally means within the tolerance range of the equipment used to produce the value, or in some examples, means plus or minus 10%, or plus or minus 5%, or plus or minus 1%, unless otherwise expressly specified. Further, herein the term "substantially" as used herein means a majority, or almost all, or all, or an amount with a range of about 51% to about 100%, for example. Moreover, examples herein are intended to be illustrative only and are presented for discussion purposes and not by way of limitation.

Where a range of values is provided, it is understood that each intervening value, to the tenth of the unit of the lower limit unless the context clearly dictates otherwise, between the upper and lower limit of that range, and any other stated or intervening value in that stated range, is encompassed within the disclosure. The upper and lower limits of these smaller ranges may independently be included in the smaller ranges, and are also encompassed within the disclosure, subject to any specifically excluded limit in the stated range. Where the stated range includes one or both of the limits, ranges excluding either or both of those included limits are also included in the disclosure. The term "about" generally refers to ±10% of a stated value.

Figure 1:
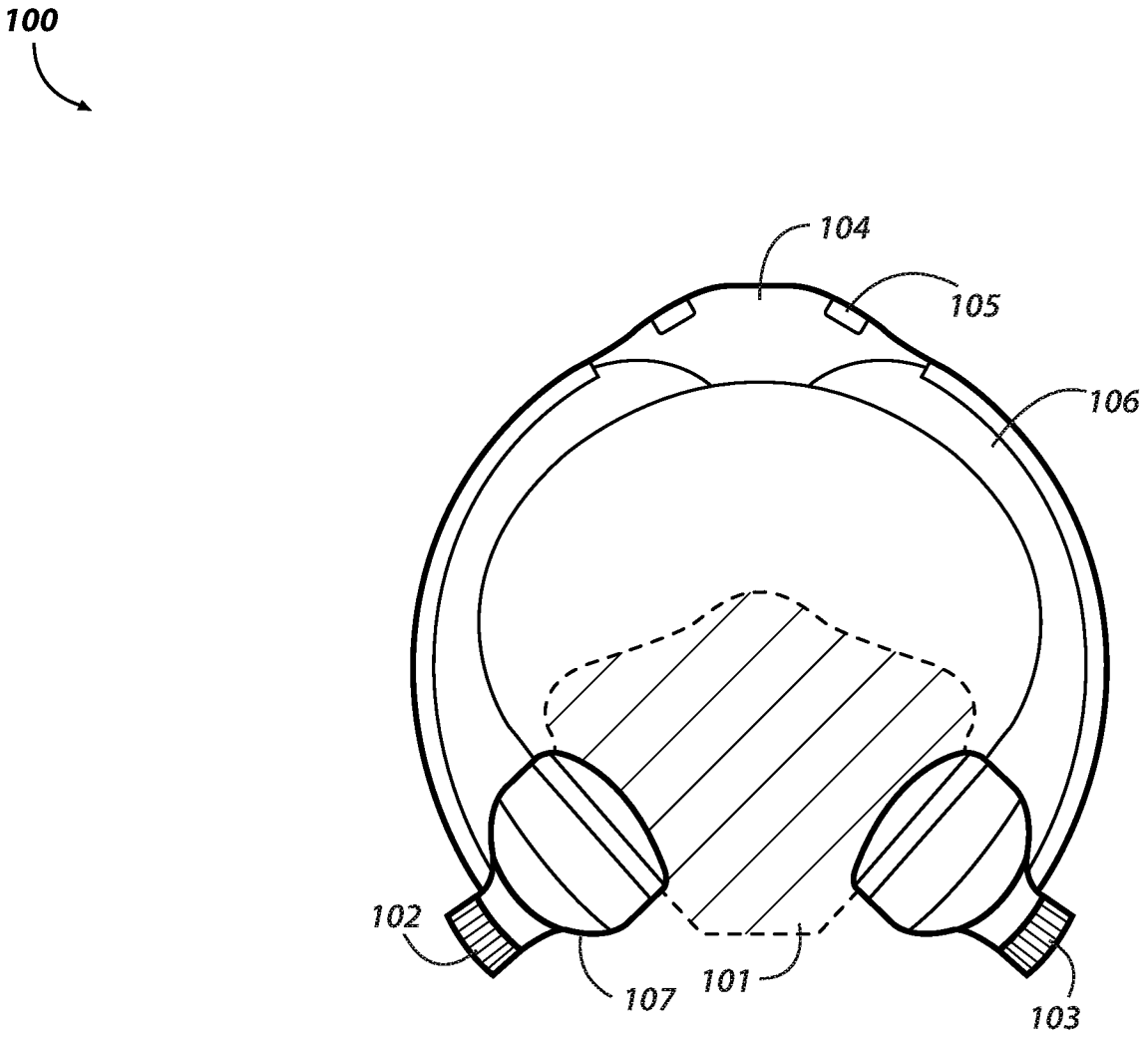
FIG. 1 is an illustration of a hands-free sound modulation apparatus in accordance with one or more embodiments of the present disclosure.

FIG. 1 is an illustration of a hands-free sound modulation apparatus in accordance with one or more embodiments of the present disclosure. The hands-free sound modulation apparatus or alternatively referred to as an electrolarynx device 100, can be employed to give individual users the ability to modulate sounds that are generated by the apparatus or external source such as, but not limited to a musical instrument (e.g., electric keyboard). An electrolarynx device 100 includes a neck band 104 with sound modulation assemblies 101, 102 coupled thereto. In the embodiment shown, sound modulation assemblies 101, 102 are suspended to end portions of the neck band 104. The sound modulation assemblies 101, 102 may be equipped with one or more rotator knobs 103 to increase or decrease the pressure of the sound modulation assemblies 101, 102 against a user's larynx.

Furthermore, the neckband 104 may be equipped with a spiral support arch 105, an amplifier (not shown), and a digital analog converter (not shown) housed within an enclosure 106. In addition, electrolarynx device 100 is equipped with one or more electrical input jacks 107. FIG. 1 also illustrates the location and exemplary area of a user's resonance chamber 108. As will be described in more detail below, the sound modulation assemblies 101, 102 held against a user's throat causes a carrier tone to be transferred to the vocal cavity. In the vocal cavity, the sound can be further creatively modulated by the user. Advantageously, the electrolarynx device functions as a musical instrument and helps facilitate musical improvisation and sound effect creation.

Herein, modulate is defined as changing musical keys, and/or adjusting, filtering, or changing a sound's tone. In some implementations, to "modulate" sound includes various sequences of starting and stopping tones to create a musical effect. Moreover, modulating sound includes expanding, restricting, or otherwise changing the area of one's oral cavity and throat chamber to change the sound emanating from the user's resonance chamber and larynx. For instance, a user can modulate an audible tone to form words and even add expressions in a sing-song manner. As such, the electrolarynx device 100 is uniquely suited to function as a musical instrument.

It should be known by those having ordinary skill in the art that the voiced speech of a typical adult male has a fundamental frequency in the range of 85 to 180 Hz and that of a typical adult female is in the range of 165 to 255 Hz. The electrolarynx device 100 may enable users to modulate sound within the aforementioned frequency ranges, but not necessarily limited thereto.

In some embodiments of the present invention, an electrolarynx device 100 may be employed as a primary device within a system (e.g., music system). The electrolarynx device 100 may be equipped with external devices that enables communication to and from the electrolarynx device 100. For example, a smartphone device which can be installed with a software application that can control the electrolarynx device 100 and can send a carrier tone thereto for music creation and performances.

A carrier tone can be generated by any suitable means known in the art. For example, a carrier tone may be generated using a synthesis or sampling technique via a software application resident on a smartphone device. Particularly, a software application may be employed such that a pre-programmed or customized carrier tone may be selected (e.g., by music producer) for use for any given application.

Once the carrier tone is generated, it can be transmitted to the electrolarynx device by any suitable means. In some embodiments, the carrier tone can be transmitted to the electrolarynx device wirelessly via a short-range wireless network (e.g., Bluetooth) utilizing a low-latency protocol. Alternatively, the carrier tone can be transmitted via a conventional wired connection as known in the art. It should be understood by one having ordinary skill in the art that the present invention is not limited to any particular mode of transmission so long as the carrier tone is effectively transmitted by the electrolarynx device.

In some embodiments, before the carrier tone is transmitted to the electrolarynx device 100, the signal is digitized. After the digital signal is received at the electrolarynx device 100, the digital signal may be converted to analog. The converted analog signal can be amplified by an amplifier component (e.g., 3W amplifier).

When in use, a user dons the electrolarynx device 100 such that the sound exciter "excites" or vibrates the resonance chamber of the user's larynx to modulate an audible tone of the carrier tones.

The neck band 104 may be flexible and may allow the electrolarynx device 100 to be positioned precisely upon the perimeter of the user's resonance chamber to maximize tone modulation and sound quality. To accommodate the various neck sizes of different users, the electrolarynx device may be fashioned such that the length of the flexible neck band is adjustable to meet the size requirements of various users.

As discussed, the flexible neck band 104 may also have a spinal support arch 105 fastened thereto. In the embodiment shown in FIG. 2, the spinal support arch 105 is attached to the ends of two-sides of the flexible neck band. In some embodiments, the flexible neck band comprises two opposing vertical support structures 104*a*, 104*b* coupled together by the spinal support arch 105. The pair of vertical support structures 104*a*, 104*b* of the flexible neck band have a flexible displacement "memory" such that each vertical support structure moves to the same degree upon each deflection.

The spinal support arch 105 is fashioned to be stationed at the top of one's spine when the electrolarynx device is in use. The spinal support arch 105 may have an arc shape such that the vertical support structures 104*a*, 104*b* are prevented from contacting the user's neck. As such, the back of the electrolarynx device 100 is designed to be displaced a certain distance away from a user's neck when the device is in use. Electrolarynx device 100 may also include a comfort band 109 which may be set in contact with the user when the user dons the electrolarynx device 100. Notably, the comfort band 109 may be flexible and may therefore accommodate various sizes (e.g., chin sizes).

Therefore, when in use, the user's body contacts the electrolarynx device 100 at the locations of the sound modulation assemblies 101, 102, and spinal support arch 105. In an embodiment of the present invention, the flexible neck band 104 is approximately 1 inch wide and 15-19 inches in length. In addition, the maximum thickness of the flexible neck band 104 near the region of the modulation sub-assembly is approximately 0.75 inches.

The flexible neck band can be disposed with a series of LEDs for aesthetic effects that flicker to indicate that when electrolarynx device is in use. The flexible neck band can also include a coupling and decoupling means (e.g., magnetic closure end regions) such that a user can easily attach and remove the electrolarynx device from the user's neck.

Figure 2:
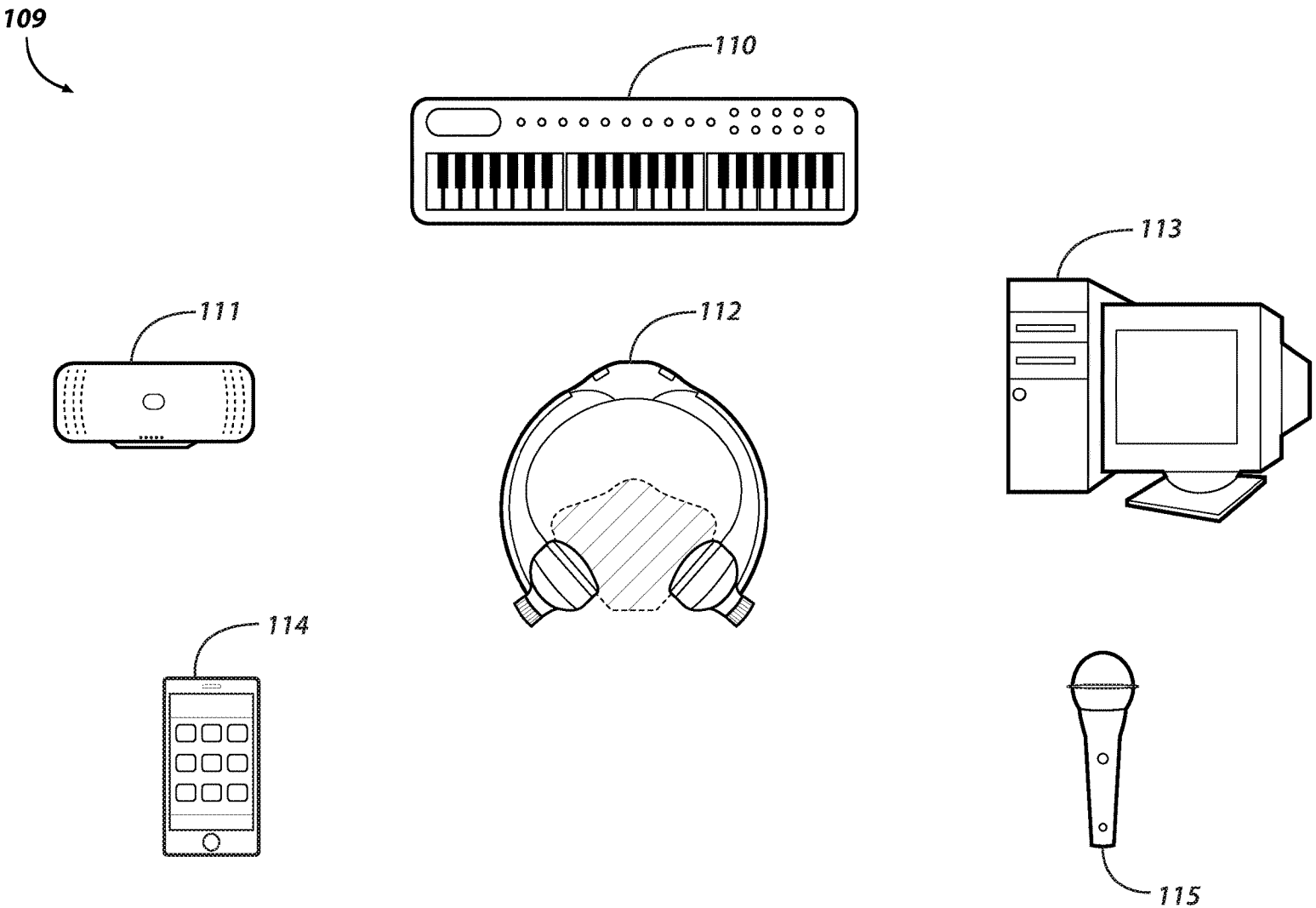
FIG. 2 is an illustration of a system which employs the hands-free sound modulation apparatus depicted in FIG. 1 in accordance with one or more embodiments of the present disclosure.

FIG. 2 is an illustration of a system which employs the hands-free sound modulation apparatus depicted in FIG. 1 in accordance with one or more embodiments of the present disclosure. As previously described herein, the electrolarynx device may be a central primary device within a system of devices that cooperate and communicate with the electrolarynx device. For example, a smartphone device 112, speaker 114, musical instrument 112, and personal computer 113 may all be components of a music system.

For example, a personal computer (e.g., laptop computer) may be employed to generates and transmits the carrier tone(s) to the electrolarynx device. The personal computer can have a software audio plug-in that is integrated into existing music creation software programs (e.g., Logic, ProTools, etc.) to generate the carrier tone(s). A music producer can therefore create various sound effects by changing the carrier tones sent to the performer's electrolarynx device while also creating additional musical effects within the producer's production tools.

The electrolarynx device includes several components to facilitate the functions described herein. For example, a flexible neck band houses a voice coil, mount, assembly, resonator, air cavity, amplifier, power supply, digital-analog converter, software controller/modulator, transmitter, and receiver.

Additionally, the electrolarynx device includes a receiver component which can receive digital audio data from an external device. For example, the receiver component can be a Bluetooth receiver which receives a Bluetooth radio signal from an external smartphone device.

The Digital-analog converter (DAC) converts the carrier tone data transmitted from an external device (e.g., smartphone) to the electrolarynx device from digital to analog audio data. For example, the DAC may convert the digital audio data carried in a Bluetooth signal into analog audio data.

The electrolarynx device includes an amplifier component. The amplifier readily amplifies the converted analog audio signal data which is subsequently fed to one or more sound exciters. Notably, the DAC, amplifier, and power source (e.g., rechargeable battery) are electrically coupled together and may be disposed upon a circuit-board assembly that is connected within the electrolarynx device.

In a preferred embodiment, the electrolarynx device includes a single high-frequency and a single low-frequency modulation sub-assembly. Ideally, the sound exciter assemblies of the electrolarynx device should be placed at the perimeter of the user's resonance chamber to maximize sound modulation and transmission. Notably, the sound exciter assemblies may exhibit a mechanical impedance that closely matches that of the average mechanical impedance attributed to the cartilage and flesh of the human throat around the larynx region.

Figure 3:
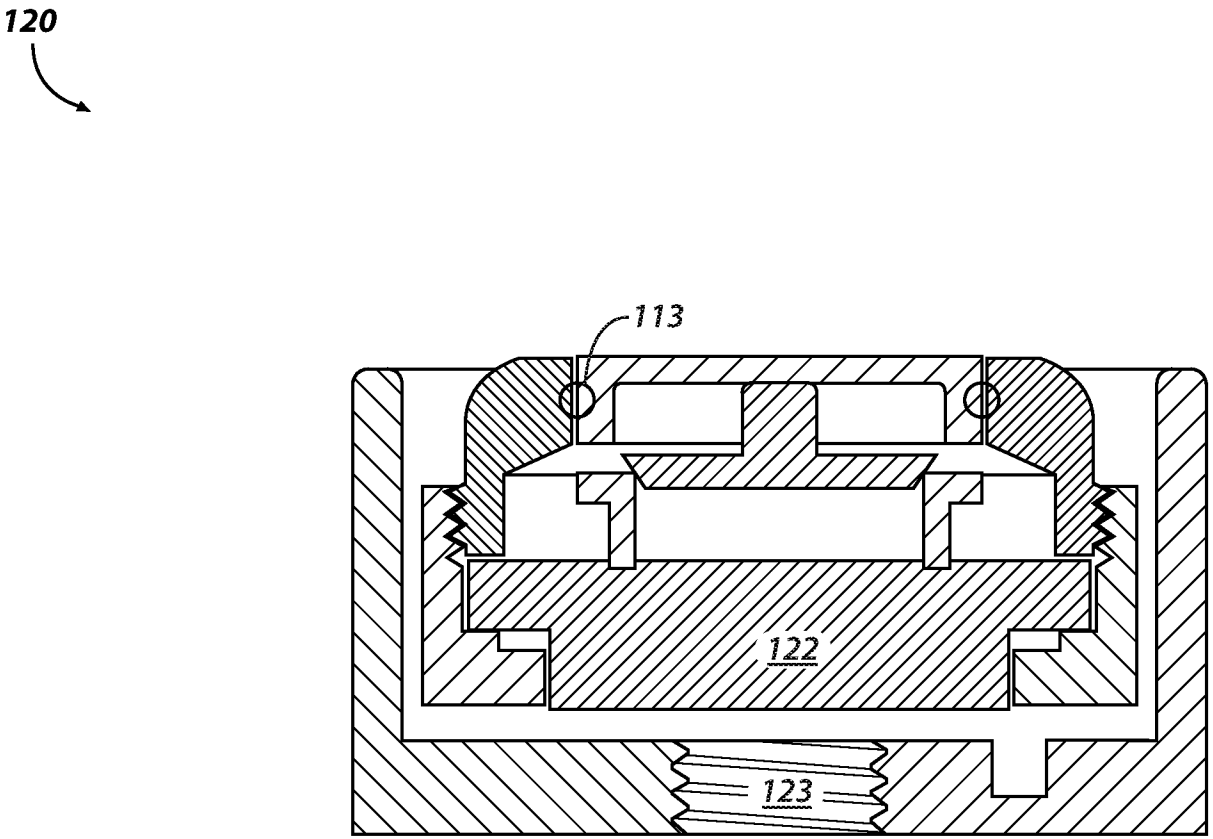
FIG. 3 is an illustration of a monophonic high-frequency sound modulation sub-assembly in accordance with one or more embodiments of the present disclosure.

FIG. 3 depicts a high-frequency modulation sub-assembly comprising a hammer and resonator sub-assembly in accordance with one embodiment of the present invention. The high-frequency modulation sub-assembly can be configured to include a voice coil which is positioned next to a magnet when the electrolarynx device all housed within a sound cup. The sound cup limits the degree that sound escapes from the exciter assembl(ies). In addition, a foam piece may be fitted between the sound cup and the exciter enclosure of the high-frequency modulation sub-assembly.

The high-frequency modulation sub-assembly is configured to "pick up" and amplify the higher frequencies of the carrier sound that is presently resident therein. In some embodiments, the high-frequency modulation sub-assembly suspended by a paper suspension (e.g., flexible spider paper suspension) in a manner that is similar to a conventional speaker design. However, the modulation sub-assembly may also include a robust plastic cap with a concentric protruding peg which acts as a hammer. When electricity is conducted to the voice coil, the voice coil can vibrate and drive the hammer component to strike a resonator (disc) to create an audible sound. The audible sound can then be modulated by a user.

In an exemplary embodiment, the hammer component is approximately 3.5 mm in height and the resonator disc comprises vinyl.

Furthermore, a high-frequency modulation sub-assembly relies upon a voice coil being coupled directly to an inside surface of an object (i.e., electrolarynx device) thereby transforming the electrolarynx device's outer surface into a speaker by imparting vibration from the modulation sub-assembly's moving mass into the surface. The vibration of the surface modulates air in a manner that sound is created.

As the hammer strikes the resonator (e.g., plastic drum disc), the modulation sub-assembly makes an audible sound which can be modulated by a user. The sound exciter system may be configured such that a modulation sub-assembly is in series with the resonator. Accordingly, the modulation sub-assembly functions as an energy source that uses the resonator to produce sound.

In some embodiments of the present invention, the resonator disc is a small circular (hard) plastic disc. The plastic disc is suspended by any suitable means such as a soft foam piece or rubber. The foam piece may be connected to a hard plastic or rubber enclosure.

Essentially, the high-frequency modulation sub-assembly uses its own movement to apply force from the voice coil to the mounting surface which is flexible enough to vibrate and produce sound. As such, any suitable material may be used to build the high-frequency modulation sub-assembly such that the assembly is preferably light weight, dense, and flexible. The high-frequency modulation sub-assembly is enclosed in a hard plastic or rubber that reduces ambient noise from the electrolarynx device such that the emitted sound is audible from the user's mouth.

Figure 4:
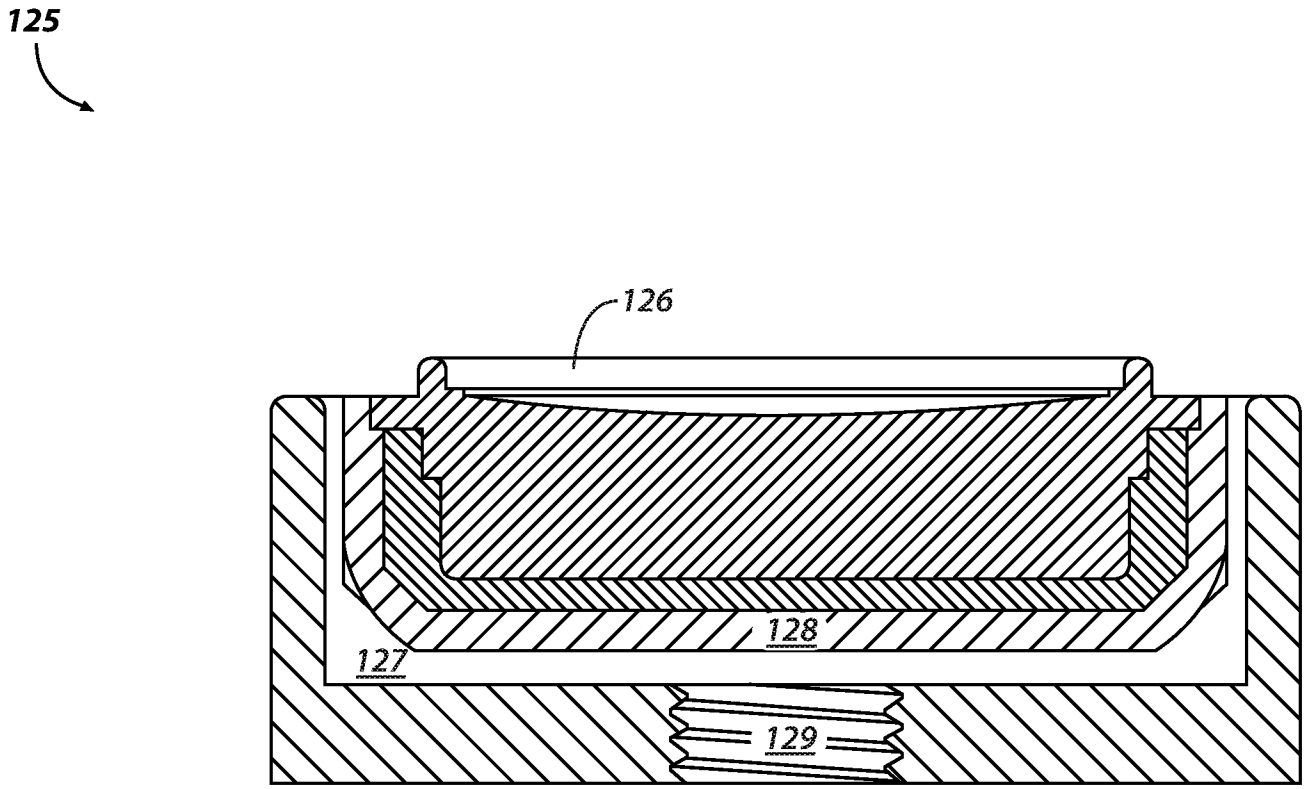
FIG. 4 is an illustration of a monophonic low-frequency sound modulation sub-assembly in accordance with one or more embodiments of the present disclosure.

The low-frequency modulation sub-assembly may be configured to "pick up" and amplify the lower frequencies of the carrier sound that is presently resident therein. Notably, as the low-frequency modulation sub-assembly operates to pick up low frequencies, this assembly is equipped without a resonator/hammer sub-assembly as the high-frequency modulation sub-assembly. FIG. 4 depicts a low-frequency modulation sub-assembly in accordance with one embodiment of the present invention.

Together, both the high and low-frequency sound exciter assemblies complement each other and precisely "picks up" sound from low to high frequencies. The frequency range, however, is not limited to the frequency range of sound. The frequency range is only limited by the carrier tone that is transmitted through the electrolarynx device.

When the electrolarynx device is in use, the high-frequency modulation sub-assembly and the low-frequency modulation sub-assembly are firmly pressed at the perimeter of the user's resonance chamber by two factors: 1) frontal pressure and 2) lateral pressure. The frontal pressure can be induced by the flexible neck band as a function of its material composition. The flexible neck band may comprise stainless steel or foam shaped-memory polymers which have a natural spring tension property. The lateral pressure may be facilitated by the addition of an external band that exerts lateral pressures on the sound exciter assemblies such that the assemblies are pulled towards each other.

The present invention is not limited to two sound exciter assemblies. Moreover, the present invention is not limited to an electrolarynx device that has the same number (e.g., 1:1) of sound exciter assemblies on each vertical support structure. For example, an electrolarynx device may have two low-frequency sound exciter assemblies on a first vertical support structure and a single high-frequency modulation sub-assembly on the opposing vertical support structure.

It should be understood, however, that the electrolarynx device may be equipped with circuitry that can emit carrier tones therefrom without the need of an external device (e.g., smartphone). The carrier tones may be pre-programmed into the electrolarynx device such that a user can choose from a plurality of carrier tone options to use to modulate sounds while the device is in use.

As described herein, the electrolarynx device can host several components and allow a user to don the device in a wearable fashion. In use, the electrolarynx device can be fitted around a user's neck via the device's flexible neck band such that the sound exciter assemblies are situated at the optimal position for maximum sound transmission and quality. As such, by placing the sound exciter assemblies against the user's resonance chamber, the audible sounds from the carrier tones are transferred through the user's vocal cavity which can be creatively modulated by the user.

In addition, the electrolarynx device may also include a graphical user interface (GUI) from which a user can select options to initiate any of various device functions (e.g., carrier tone options).

In use, the electrolarynx device's temperature may elevate significantly. A temperature sensor (e.g., a thermocouple) may be incorporated within the electrolarynx device to alert the user if the elevated temperature of the device exceeds a threshold level (e.g., safe level). In the event that the temperature exceeds the threshold level, the electrolarynx device may activate alerts to inform the user. In some embodiments of the present invention, the LEDs flash in a sequence to indicate that the electrolarynx device has exceeded a safe level and should therefore be removed from the user's neck. In addition, the electrolarynx device may be programmed such that if the temperature alert is engaged for a certain time period, the electrolarynx device automatically shuts off.

In addition, the electrolarynx device may comprise actuators coupled to the sound exciter assemblies. The actuators, when engaged, can move in one or two directions—towards or away from the flexible neck band thereby increasing or decreasing the pressure that the exciter assemblies exerts on the user's neck. Doing so can facilitate the user to effect high, medium, or low frequencies associated with the carrier tones that are modulated through the user's mouth.

In an alternative embodiment, the flexible neck band incorporates displacement knobs at the location where the sound exciter assemblies contact respective ends of the vertical support structures 104*a*, 104*b*. In particular, the thread portions of the displacement knobs enable the user to separate the sound exciter assemblies from or bring the sound exciter assemblies closer to the vertical support structures 104*a*, 104*b* of the flexible neck band. As such, users can adjust the knobs to effect a desired sound modulation and quality. For example, turning the displacement knob clockwise may move an assembly away from the flexible neck band whereas turning the displacement knob counterclockwise may bring the assembly towards the flexible neck band.

The electrolarynx device may also include one or more adaptors such that peripheral devices may be attached thereto. For example, the electrolarynx device may allow a speech tube to be connected thereto via an adaptor such that a user can further modulate the sound in a manner that is similar to a talk box. External memory, power source(s), and additional apparati (e.g., 360° cameras) may be attached to the electrolarynx device to maintain, increase, or augment the device's functionality.

In some implementations, the power supply that powers the electrolarynx device is a rechargeable battery. The rechargeable battery may also provide power for the amplifier and DAC. A lithium ion polymer battery (3.7 v, 950 mAh) may be an exemplary rechargeable battery that is suitable for the electrolarynx device.

A plurality of electrolarynx devices may be networked together in a system such that they all receive communications from a single external device. For instance, a group of artists within a band may each don an electrolarynx device that receives the same carrier tone from a smartphone device that is used during a musical performance. In yet another embodiment, a smartphone device may send a unique carrier tone to each of the electrolarynx devices such that the sounds emanate from the band occur in a harmonious fashion.

The networked plurality of electrolarynx devices may communicate with each other wirelessly. For example, each electrolarynx device may have an internal memory that stores carrier tones. A user may initiate a transmission of any particular carrier tone, such as a customized carrier tone, to another electrolarynx device via wireless transmission. Upon receipt, the receiving electrolarynx device can transmit the received carrier tone.

The electrolarynx device may also have a recording means such that a session can be recorded, stored in memory, and optionally transmitted to an external device (e.g., a computer, smartphone, other musical instrument). The recorded session may be stored in internal memory of an electrolarynx device.

A process for implementing a system consistent with the present invention is disclosed herein. The system described in the following process represents a single embodiment and therefore the present invention is not limited thereto. In particular, the following process describes an embodiment when the carrier tone is generated from a smartphone device and transmitted to the electrolarynx device.

The process begins with the generation of a synthesized tone via a software application in operation on a smartphone device. The synthesized tone(s) generated may be based on analog modeling, digital synthesis, or from a pre-recorded melodic tone. At any time, a user may start or stop the generation or transmission of the carrier tone using the software application.

A user may have the ability via the software application to change the pitch (in both musical and non-musical intervals) using an on-screen graphical user application. The software application may also play melodies that emanate from an external device such that a user can sing along.

Next, the carrier tone is converted into a digital audio data stream. Once converted, the digital audio data stream is transmitted wirelessly from the smartphone device to the electrolarynx device communicatively coupled thereto.

Once the digital audio data stream is received at the electrolarynx device, the data stream is converted to analog by a DAC housed in the electrolarynx device. Next, electricity is conducted to engage the voice coil in the modulation sub-assembly. Finally, within the high-frequency modulation sub-assembly, the voice coil vibrates and drives a hammer that strikes a resonator such that an audible sound is generated.

The hands-free musical instrument apparatus depicted in FIG. 1 is notably monophonic. Disclosed herein monophonic refers to a single dominant tonal frequency of sound transmission or "note". As such, the high-frequency sound exciter assembly(ies) transmit monophonic sounds regardless of the monophonic or polyphonic nature of the accompanying carrier tone.

Figure 5:
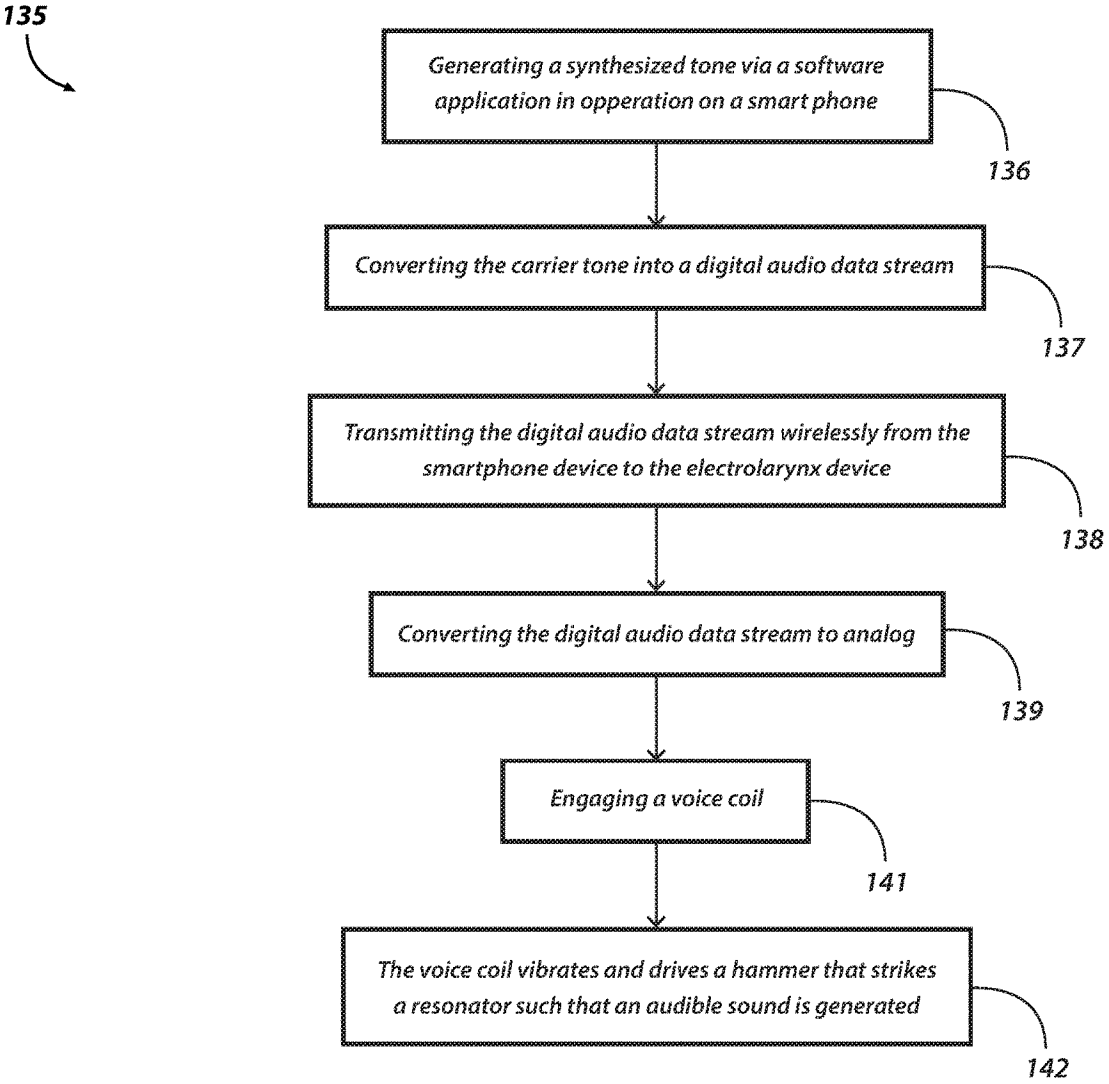
FIG. 5 is a flowchart depicting a method for modulating sound by a music apparatus.
Figure 6:
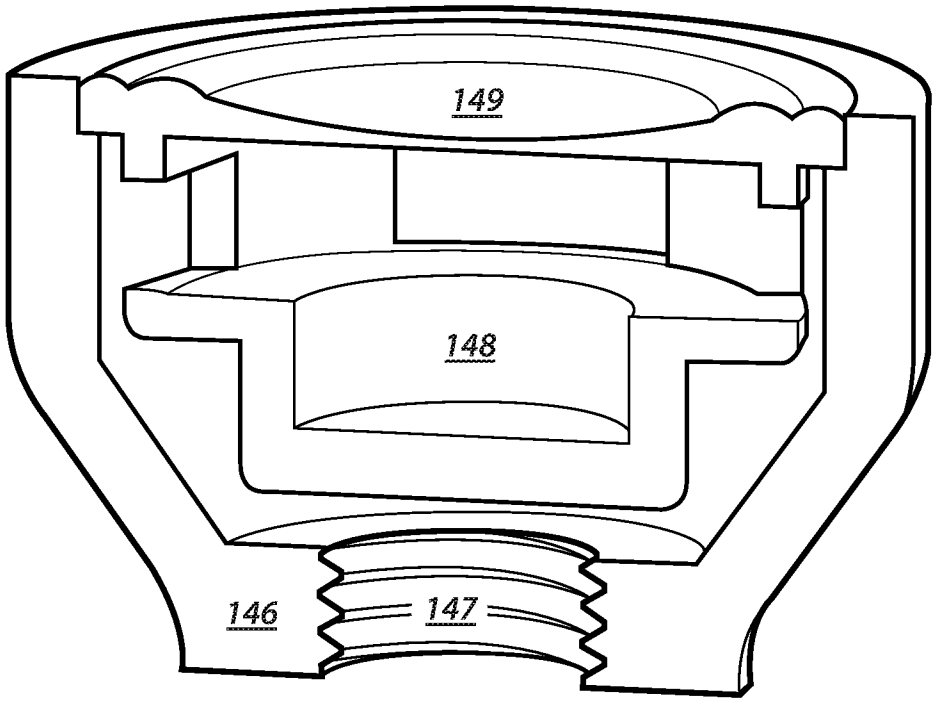
FIG. 6 is a polyphonic modulation sub-assembly in accordance with one or more embodiments of the present disclosure.

However, the present invention is not limited to a hands-free musical instrument apparatus that transmits monophonic sounds. FIG. 5 is a hands-free musical instrument apparatus operable to transmit polyphonic sounds. Herein, polyphonic refers to the ability to transmit many sounds or "notes" simultaneously. As the monophonic hands-free musical instrument apparatus may produce a metallic effect as a result of the hammer/resonator sub-assembly, a polyphonic hands-free musical instrument apparatus a fuller, rich harmonious effect.

A polyphonic hands-free musical instrument apparatus consistent with the present invention comprises at least one polyphonic modulation sub-assembly. For instance, a polyphonic hands-free musical instrument apparatus comprises a polyphonic modulation sub-assembly and a monophonic modulation sub-assembly. In yet another embodiment, a polyphonic hands-free musical instrument apparatus comprises two polyphonic modulation sub-assemblies.

In the embodiment that the hands-free musical instrument apparatus comprises a monophonic modulation sub-assembly and a polyphonic modulation sub-assembly, the monophonic modulation sub-assembly includes a hammer/resonator sub-assembly as described above and the polyphonic modulation sub-assembly includes a speaker sub-assembly such that the polyphonic sounds can be transmitted. In some implementations, the monophonic modulation sub-assembly may be well suited to transmit high frequencies whereas the polyphonic modulation sub-assembly may be well suited to transmit rich musical multi-sound signals.

Likewise, in the embodiment where the polyphonic hands-free musical instrument apparatus comprises dual polyphonic modulation sub-assemblies, each assembly includes a speaker sub-assembly. In some implementations, a polyphonic modulation sub-assembly does not include a sound cup.

The electrolarynx device and related system is advantageous over prior art systems as it enables pitched frequency modulation of carrier tones using a smartphone software application. In addition, the system enables non-pitched frequency modulation for continuously variable frequency modulation of carrier tones using the software application to simulate tonal variations in tonal languages or to add vocal expressions.

The electrolarynx device and music production system also makes use of recorded vocal tone samples to be used as carrier tones which can be wirelessly transmitted to the electrolarynx device. Likewise, the electrolarynx device can leverage external devices (e.g., smartphone) to record audio and video data of an individual using the device.

Advantageously, the electrolarynx device is a single, compact device that is both portable and rechargeable. The device is also able to connect to a wireless network such that the device can send and receive data at a user's discretion.

The foregoing description, for purposes of explanation, used specific nomenclature to provide a thorough understanding of the disclosure. However, it will be apparent to one skilled in the art that the specific details are not required in order to practice the systems and methods described herein. The foregoing descriptions of specific examples are presented for purposes of illustration and description. They are not intended to be exhaustive of or to limit this disclosure to the precise forms described. Obviously, many modifications and variations are possible in view of the above teachings. The examples are shown and described in order to best explain the principles of this disclosure and practical applications, to thereby enable others skilled in the art to best utilize this disclosure and various examples with various modifications as are suited to the particular use contemplated. It is intended that the scope of this disclosure be defined by the claims and their equivalents below.

The invention claimed is:

1. An apparatus, comprising:

a flexible neck band having an adjustable length, comprising:

at least one modulation sub-assembly disposed within a first and second interior region of the flexible neck band;

an amplifier disposed within a third interior region of the flexible neck band;

an integrated power supply at a fourth region of the flexible neck band;

wherein the at least one modulation sub-assembly, the amplifier, and the integrated power supply are to be connected as a circuit;

wherein the at least one modulation sub-assemblies comprise a monophonic modulation sub-assembly and a polyphonic modulation sub-assembly.

2. The apparatus of claim 1, wherein the flexible neck band includes a digital-analog-converter (DAC) and a receiver device disposed within a fourth region of the flexible band.

3. The apparatus of claim 1, wherein the flexible neck band comprises a memory device within a fifth interior region of the flexible neck band.

4. The apparatus of claim 1, wherein the flexible neck band comprises a high-frequency modulation sub-assembly and a low-frequency modulation sub-assembly.

5. The apparatus of claim 1, wherein at least one modulation sub-assemblies comprise a monophonic modulation sub-assembly and a polyphonic modulation sub-assembly.

6. A hands-free musical instrument, comprising:

a flexible neck band having a first vertical structure member and a second and opposing vertical structure member coupled together at one end by a spinal support structure, the flexible neck band comprising:

a high-frequency modulation sub-assembly disposed on a first end of the flexible neck band;

a low-frequency modulation sub-assembly disposed a second end of the flexible neck band;

an amplifier disposed within a first interior region of the flexible band;

an integrated power supply at a second region of the flexible neck band; wherein the high-frequency modulation sub-assembly and the low-frequency modulation sub-assembly, the amplifier, and the integrated power supply are to be connected as a circuit; and a digital-analog-converter (DAC) and a receiver device disposed within a fourth region of the flexible neck band.

7. The hands-free musical instrument of claim 6 further comprising an adaptor to facilitate an electrical connection with an external device.

8. The hands-free musical instrument of claim 6, wherein the high-frequency modulation sub-assembly comprises a hammer and resonator sub-assembly.

9. The hands-free musical instrument of claim 6 further comprising an actuator coupled to the low-frequency modulation sub-assembly and the high-frequency modulation sub-assembly to adjust the displacement of the high-frequency modulation sub-assembly and the low-frequency modulation sub-assembly from the first and second ends of the vertical support structure of the flexible neck band.

10. The hands-free musical instrument of claim 6, wherein the flexible neck band comprises a graphical user interface which allows access to a plurality of carrier sound options.

11. The hands-free musical instrument of claim 6 further comprising a temperature sensor to determine the temperature of the hands-free musical instrument.

12. A system, comprising:

a first electrolarynx device, comprising:

a flexible neck band having an adjustable length, comprising:

a first monophonic modulation sub-assembly and a first polyphonic modulation sub-assembly disposed within a first and second interior regions of the flexible band;

an amplifier disposed within a third interior region of the flexible neck band;

an integrated power supply at a fourth region of the flexible neck band;

wherein the first monophonic sub-assembly and the first polyphonic modulation sub-assembly, the amplifier, and the integrated power supply are to be connected as a circuit;

a digital-analog-converter (DAC) and a receiver device disposed within a fifth region of the flexible band; and a smartphone device communicatively coupled to the first electrolarynx device;

the smartphone device is operable to generate a plurality of carrier signals; and a transmitter operable to transmit a carrier signal to the first electrolarynx device.

13. The system of claim 12 further comprising a speech tube electrically connected to the first electrolarynx device.

14. The system of claim 12 further comprising a second electrolarynx device communicatively coupled to the first electrolarynx device.

15. The system of claim 14, wherein the second electrolarynx device is communicatively coupled to the smartphone device.

16. The system of claim 12 further comprising a speaker communicatively coupled to the first electrolarynx device, the second electrolarynx, and the smartphone device.

17. The system of claim 12 further comprising a personal computer equipped with music production software that also has the capability to generate carrier signals.

18. The system of claim 16, wherein the personal computer comprises a transmitter to transmit the carrier signals.

19. The system of claim 12, wherein the first electrolarynx device further comprises a set of LEDs that are operable to flash at a pre-programmed sequence and frequency to indicate that a threshold temperature of the first electrolarynx device is exceeded.

* * * * *